US007340977B2

(12) United States Patent
Agnew et al.

(10) Patent No.: US 7,340,977 B2
(45) Date of Patent: Mar. 11, 2008

(54) BRAKE MECHANISM HAVING ARTICULATED BEAM AND CAM

(75) Inventors: David Leslie Agnew, Clarkston, MI (US); Michael Charles Carr, Oxford, MI (US)

(73) Assignee: Continental Tevis, Inc., Auburn Hills, MI (US)

( * ) Notice: Subject to any disclaimer, the term of this patent is extended or adjusted under 35 U.S.C. 154(b) by 706 days.

(21) Appl. No.: 10/789,973

(22) Filed: Feb. 27, 2004

(65) Prior Publication Data

US 2005/0188780 A1 Sep. 1, 2005

(51) Int. Cl.
*G05G 1/14* (2006.01)

(52) U.S. Cl. ..... 74/512

(58) Field of Classification Search ..... 74/512, 74/516, 518

See application file for complete search history.

(56) References Cited

U.S. PATENT DOCUMENTS 1,754,354 A * 4/1930 Gans ..... 74/512
1,808,121 A * 6/1931 Smith ..... 74/512
2,315,632 A * 4/1943 Martindill ..... 74/518
3,633,366 A 1/1972 Cripe
3,719,123 A 3/1973 Cripe
3,788,161 A * 1/1974 Krusemark ..... 74/516
3,810,400 A * 5/1974 Schroter ..... 74/518
4,386,537 A * 6/1983 Lewis ..... 74/512
4,615,235 A * 10/1986 Horvath ..... 74/516
4,624,152 A * 11/1986 Stotz et al. ..... 74/518
6,446,526 B2 * 9/2002 Reimann et al. ..... 74/512
7,082,853 B2 * 8/2006 Fujiwara ..... 74/512

* cited by examiner

*Primary Examiner*—Vicky A. Johnson

(57) ABSTRACT

A brake mechanism includes a pedal arm, a beam and a cam. The pedal arm is pivotally connected to the vehicle, while the beam is interposed between the pedal arm and the input rod for transmitting force from the pedal arm to the input rod. The beam is pivotally connected to the pedal arm and rotatable relative thereto. The cam defines a cam profile, and the beam contacts the cam and follows the cam profile as the pedal arm is activated. The cam profile is shaped to adjust the position of the beam relative to the pedal arm as the pedal arm swings relative to the vehicle. In this way, a variable force ratio is provided to maintain brake pedal feel while achieving an acceptable force ratio for failed power situations. The mechanism can be designed such that the force ratio does not drop off further into the pedal travel.

20 Claims, 5 Drawing Sheets

BRAKE MECHANISM HAVING ARTICULATED BEAM AND CAM

FIELD OF THE INVENTION

The present invention relates generally to brake pedal mechanisms for motor vehicles, and more particularly relates to braking mechanisms providing a variable force ratio.

BACKGROUND OF THE INVENTION

A brake pedal mechanism is usually employed to effectuate braking of a motor vehicle through its braking system. The braking system typically includes a brake booster which supplements the braking force provided by the vehicle operator, which in turn operates a hydraulic master cylinder for pressurizing fluid and the brake lines and applying a braking force to the wheels of the vehicle via individual wheel brakes. The brake pedal mechanism is typically a simple lever, wherein a pedal arm has the brake pedal at one end while the opposing end is pivotally connected to the vehicle frame. An input rod leading to the brake booster is connected to the pedal arm, and based on the position of its connection to the pedal arm, the lever action of the pedal arm increases the output force generated by the input force on the brake pedal, i.e. forms a force ratio of the output force divided by the input force.

One common problem with these typical braking mechanisms is that performance of the brake system often ends in a compromise between having enough force capability to stop the vehicle under mandated failure mode conditions and not having too much pedal travel to maintain good pedal feel. That is because to increase the force ratio the distance the pedal must travel must be increased. If a vehicle is marginal in meeting a deceleration requirement with a given brake pedal input force, a typical step is to increase the brake pedal ratio, resulting in greater braking force and vehicle deceleration. Unfortunately, increasing the force ratio increases the pedal input travel required to meet the same rate of deceleration.

Some designs have attempted to address the problem by providing a multiple link brake pedal which lowers the pedal travel initially, when the pedal is at low stroke and relatively low force values. The concept is that an increase in the force required in this range is acceptable since initial forces are low. Unfortunately, the nature of the linkages results in an overshoot of the ratio required at failed power conditions. This also results in some of the pedal stroke gained initially being lost during the remainder of the pedal travel. That is, the force ratio will steadily increase with pedal travel, but then quickly drops off as pedal travel increases further towards a fully extended position. Thus, the brake system parameters become extremely critical since it must be assured that the failure conditions occur only in the pedal travel zone which provide an adequate force ratio.

Accordingly, there exists a need to provide a simple brake mechanism for use with the braking system in a motor vehicle which does not have too much pedal travel to maintain good pedal feel, but yet provides a sufficient force ratio under failure mode conditions to provide sufficient force capability to stop the vehicle. Ideally, such a brake mechanism also eliminates the unwanted drop off in force ratio as the pedal travel increases towards a fully extended position.

BRIEF SUMMARY OF THE INVENTION

One embodiment of the present invention provides a brake mechanism for a braking system in a motor vehicle. The braking system includes an input rod for effecting actuation of vehicle brakes. The brake mechanism includes a pedal arm, a beam and a cam. The pedal arm is pivotally connected to the vehicle, while the beam is interposed between the pedal arm and the input rod for transmitting force from the pedal arm to the input rod. The beam is pivotally connected to the pedal arm and rotatable relative thereto. The cam defines a cam profile, and the beam contacts the cam and follows the cam profile as the pedal arm is activated. The cam profile is shaped to adjust the position of the beam relative to the pedal arm as the pedal arm swings relative to the vehicle. In this way, a variable force ratio is provided to maintain brake pedal feel while achieving an acceptable force ratio for failed power situations. Further, the mechanism can be designed such that the force ratio does not drop off further into the pedal travel.

According to more detailed aspects, the position of the beam relative to the pedal arm determines the force ratio of the brake mechanism. The beam is pivotally connected to the input rod, and the beam rotates relative to the input rod as the pedal arm swings relative to the vehicle. The pedal arm travels between at least a neutral position and an extended position, and the force ratio quickly increases as the pedal arm travels beyond a predetermined point past the neutral position to the extended position. The force ratio at the extended position is sufficient for vehicle braking in a failed power situation. In one embodiment, the beam is generally perpendicular to the input rod when the pedal arm is in the neutral position, and the beam is aligned with the input rod when the pedal arm is in the extended position. The cam profile includes a first portion generally perpendicular to the input rod and a second portion generally parallel to the input rod. The cam profile preferably includes a third portion connecting the first and second portions, the third portion being curved in shape.

Another embodiment of the present invention provides a brake mechanism for a braking system in a motor vehicle, the braking system including an input rod for transmitting force to a master cylinder for pressurizing braking fluid in brake lines leading to wheel brakes. The brake mechanism includes a pedal arm pivotally connected to the vehicle, the pedal arm receiving an input force from an operator of the vehicle. A beam is pivotally connected to the pedal arm at a first point along the beam. The beam is connected to the input rod at a second point along the beam. The beam transmits force from the pedal arm to the input rod. A cam has a surface defining a cam profile. The beam contacts the cam at a third point along the beam and follows the cam profile. The beam pivots relative to the pedal arm as the beam follows the cam profile. Again, a variable force ratio is provided to maintain brake pedal feel while achieving an acceptable force ratio for failed power situations, without unwanted drop-offs in the force ratio.

According to more detailed aspects, the position of the beam relative to the pedal arm is determined by the shape of the cam profile. Likewise, the position of the second point relative to the first point is determined by the shape of the cam profile. The position of the second point relative to the first point determines the force ratio of the braking mechanism. The second point moves from a position vertically below the first point to a position substantially horizontally aligned with the first point. The pedal arm travels between a non-braked position and a braked position, and wherein the second point moves vertically upward as the pedal arm travels from the non-braked position to the braked position. The cam profile preferably includes a substantially vertical surface transitioning into a substantially horizontal surface.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE INVENTION

Figure 1:
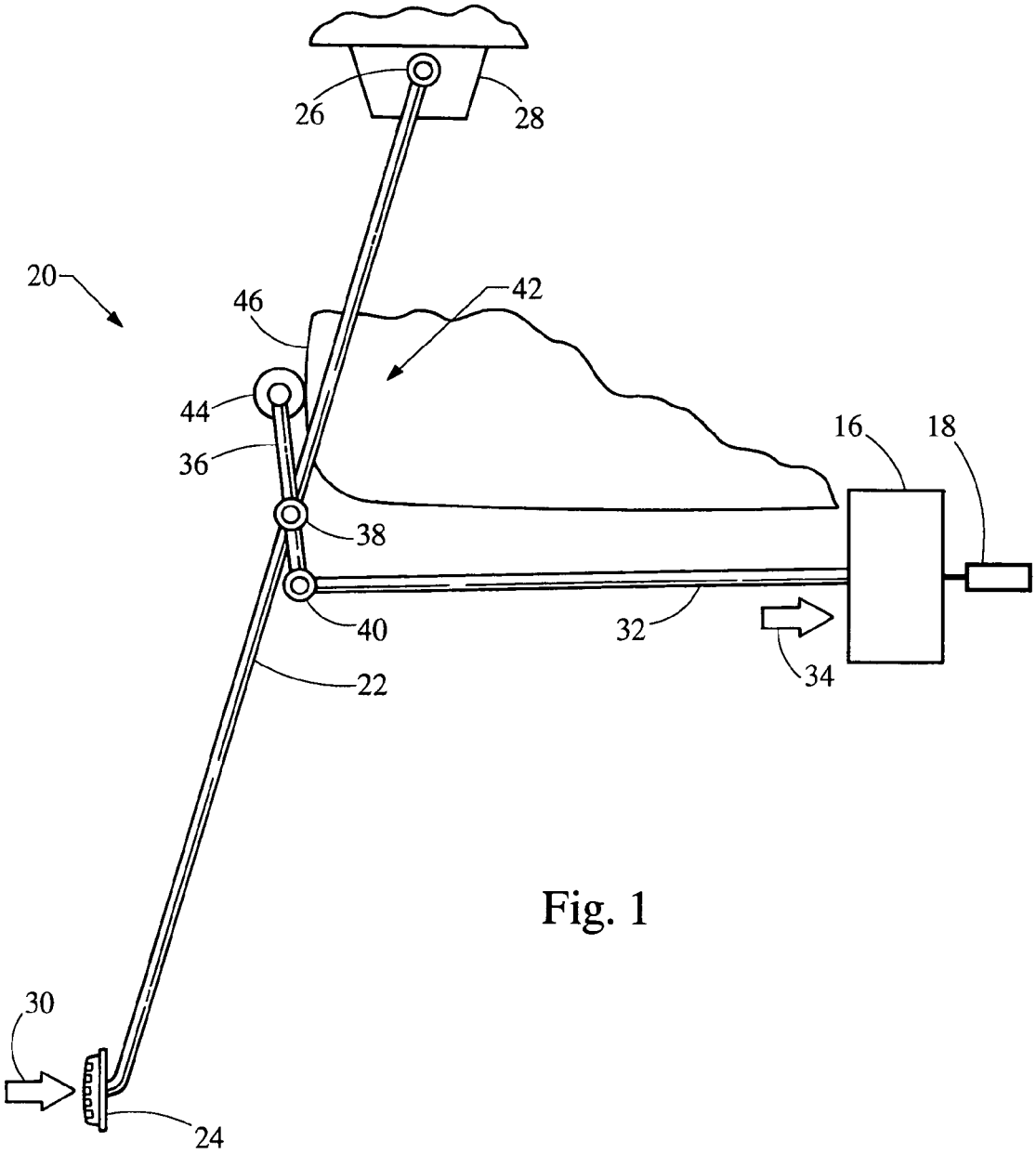
FIG. 1 is a schematic view of the brake mechanism constructed in accordance with the teachings of the present invention.

Turning now to the figures, FIG. 1 depicts a schematic illustration of a brake mechanism 20 constructed in accordance with the teachings of the present invention. The brake mechanism 20 comprises a portion of the braking system in a motor vehicle, the braking system including an input rod 32 for effecting actuation of the vehicle brakes, typically through a brake booster 16 and a master cylinder 18 pressurizing fluid in the brake lines leading to the individual wheel brakes.

The brake mechanism 20 generally includes a pedal arm 22 having a brake pedal 24 at a first end of the pedal arm 22 which is depressed by. A pivotal connection 26 is made at the opposing end of the pedal arm 22 for rotatably connecting the pedal arm 22 to the frame 28 of the vehicle. The operator of the vehicle provides an input force 30 to the brake pedal 24 which cause the pedal arm 22 to rotate about its pivotal connection 26. The input force 30 is transmitted to the input rod 32 for providing an output force 34 and effecting actuation of the vehicle brakes.

An idler beam 36 is interposed between the pedal arm 22 and input rod 32. The beam 36 is pivotally connected to the pedal arm 22 at pivotal connection 38. A first end of the beam 36 makes a pivotal connection 40 with the input rod 32. The opposing end of the beam 36 includes a roller 44 which engages a cam 42 for regulating the position of the beam 36 and hence the transmission of force from the pedal arm 22 to the input rod 32, as will be described in more detail herein. In the neutral un-braked position shown in FIG. 1, the pressure in the master cylinder 18 and booster 16 biases the input rod 32 to the left in the figure, thereby pressing the roller 44 against the cam 42 in the neutral position.

The cam 42 provides a cam surface 46 on which the roller 44 rides, thereby controlling the position of the beam 36 as the pedal arm 22 rotates through its travel path. It will be recognized that the cam 42 could provide a track which the beam 36 would engage and follow through the pedal travel. Other engagement mechanisms allowing relative movement will also be readily envisioned by those skilled in the art.

Figure 2:
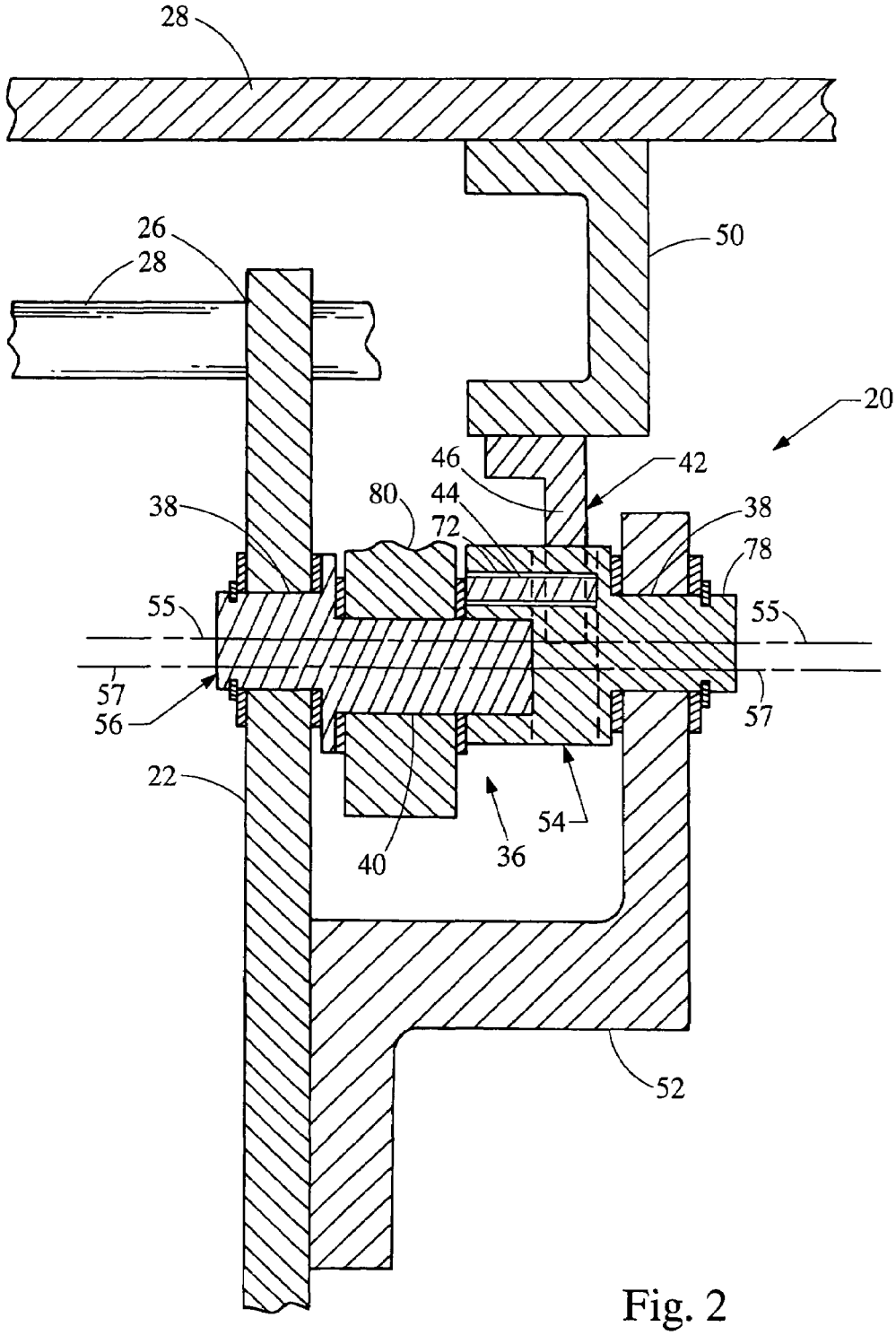
FIG. 2 is a detailed front view of a brake mechanism constructed in accordance with the teachings of the present invention.
Figure 3:
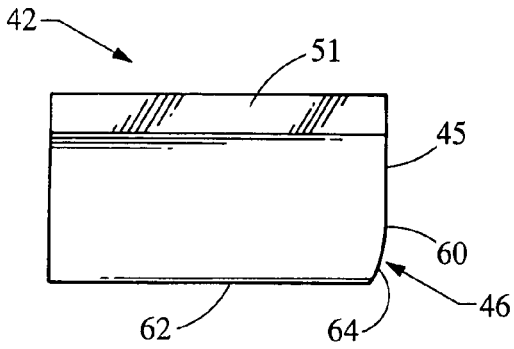
FIGS. 3-6 are detailed view of specific components forming the brake mechanism depicted in FIG. 2.

Turning now to FIG. 2, a detailed front view of an embodiment of the brake mechanism 20 is depicted. It can be seen that the pedal arm 22 is pivotally connected to the frame 28 at pivotal connection 26. The frame 28 is also utilized to allow the cam 42 to be positioned relative to the rest of the mechanism 20 using a channel 50 or other supporting structure which is attached to the frame 28 in any known manner. Details of the cam 42 can be found in FIG. 3. The cam 42 includes a flange 51 for connecting the cam 42 to the support channel 50. An end 45 of the cam 42 defines the cam surface 46 which includes an upper portion 60 which is substantially vertical, a second portion 62 which is substantially horizontal, and a third portion 64 which is curved and links the first portion 60 to the second portion 62.

Figure 4:
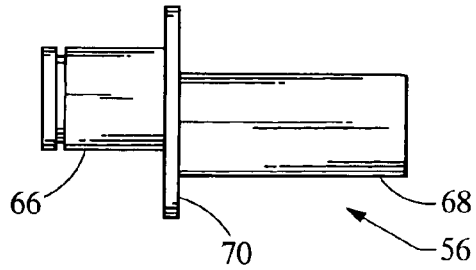
Figure 5:
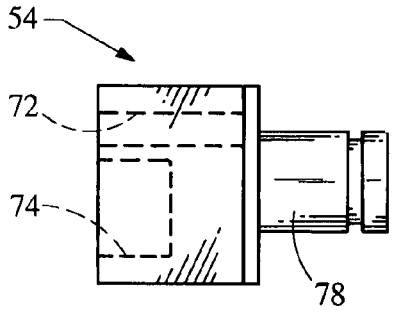
Figure 6:
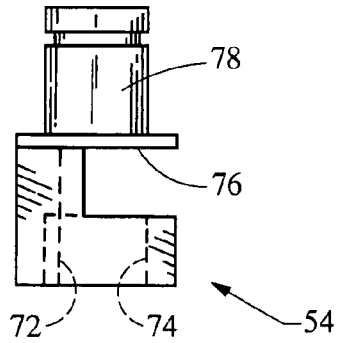

The idler beam 36 is comprised of two primary pieces, namely a crank 54 and an offset pin 56. Details of the offset pin 56 can be found in FIG. 4. Details of the crank 54 can be found in FIGS. 5 and 6. The offset pin 56 includes a first portion 66 which is fit through a pedal arm 22 to provide the pivotal connection 38 thereto about axis 55. A second portion 68 of the offset pin 56 is separated from the first portion by a flange 70, and the second portion 68 is structured to connect to the crank 54. The crank 54 includes a first bore 72 which is sized and positioned to receive the roller 44 (FIG. 2) for engaging the cam surface 46. A second bore 74 is formed in the crank 54 for receiving the second portion 68 of the offset pin 56.

A support arm 52 is connected to the pedal arm 22 for providing additional support to the idler beam 36. A pin portion 78 of the crank 54 is structured and positioned to extend through the support arm 52, also providing a pivotal connection therewith about an axis denoted by line 55 in FIG. 2. Accordingly, the pivotal connection 38 is formed by both the offset pin 56 (via first portion 66) and the crank 54 (via pin portion 78), which are pivotally attached to the pedal arm 22 and support arm 52, respectively. Finally, the crank 54 includes a notch 76 (best seen in FIG. 6) which is sized to receive the cam 42, as well as to expose the bore 72 and more particularly the roller 44 to the cam surface 46 for engagement therewith.

Accordingly, as best seen in FIG. 2, the idler beam 36 comprises the offset pin 56 attached to the crank 54, the combination of which is pivotally mounted to the pedal arm 22 via pin portions 66 and 78. The second portion 58 of the offset pin 56 forms the pivotal connection 40 with the input rod 32 via the brake switch 80. The brake switch 80 is directly connected to the input rod 32 and provides a signal of braking (i.e. for the taillights), and transfers force from the idler beam 36 to the input rod 32. The brake switch 80 is fitted over the second portion 68 of the offset pin, thereby forming the pivotal connection 40 on a second rotational axis 57 that is offset from the rotational axis 55 of the first pivotal connection 38.

Figure 7:
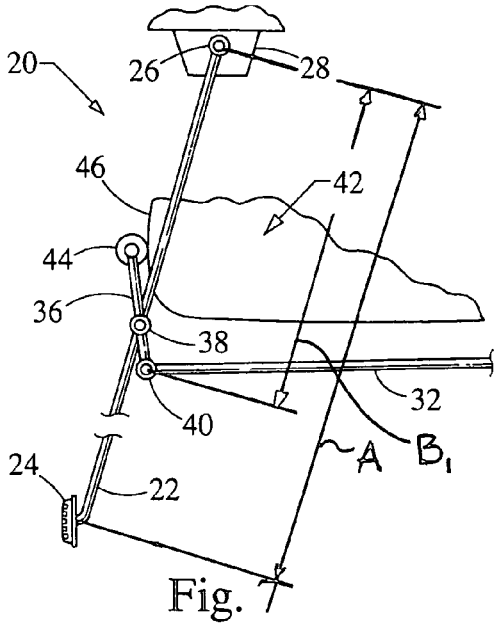
FIGS. 7-11 are a series of side views schematically depicting the operation of the brake mechanism depicted in FIG. 1 through the range of pedal travel.
Figure 8:
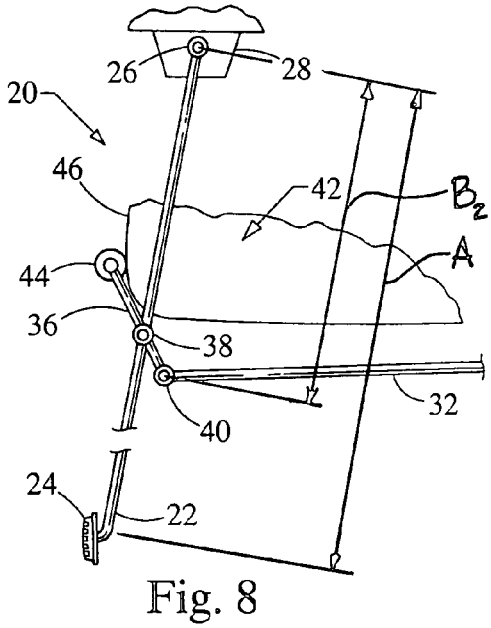

Operation of the brake mechanism 20 will now be described with reference to FIGS. 7-11, which depicts a sequence of illustrations showing the travel of the pedal arm 22 (and thus travel of the input rod 32). FIG. 7 depicts the pedal arm 22 and brake pedal 24 in an unbraked or neutral position. In this position, the pedal 24 is located a distance A from the pivotal connection 28, while pivotal connection 40 (i.e. the point of force transmission in input rod 32) is located a distance $B_1$, from pivotal connection 28. This gives a force ratio of $A/B_1$, for the neutral or initial un-braked position. As previously described, the input rod 32 is biased towards the pedal arm 22 resulting in the idler beam 36 taking the position shown in FIG. 7, i.e. having its roller 44 engaging the cam surface 46.

As the vehicle operator places an input force on the brake pedal 24, the pedal arm 22 rotates towards the input rod 32. The force is transmitted through the beam 36 to the input rod 32, which moves to the right in FIG. 8. It can be seen that the beam 36 follows with the roller 44 engaging the cam surface, causing the beam 36 to rotate counterclockwise. Since the beam 36 has rotated, it will also be recognized that the pivotal connection 40 has rotated relative to the point 38. Thus, the pivotal connection 40 is now closer to pivotal connection 28, giving a shorter distance $B_2$ and a greater force ratio equal to $A/B_2$.

Figure 9:
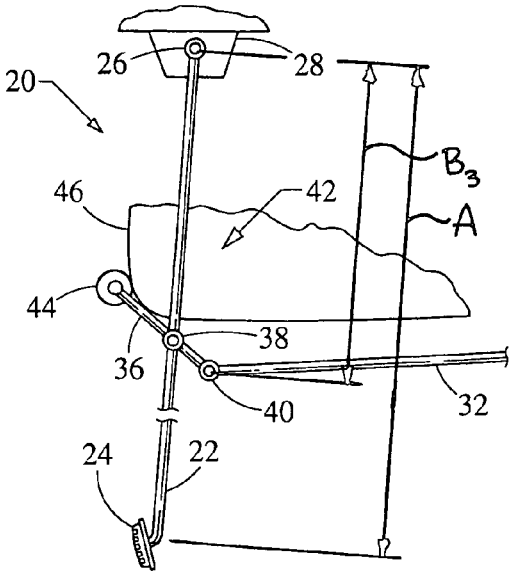

Moving to FIG. 9, the pedal arm 22 has been rotated further into its path of travel, with the force continuing to be transmitted to the input rod 32 causing the rod to move to the right in the figure. Again, the idler beam 36 also rotates as it is forced to the right in the figure by the pedal arm 22, while the engagement of the roller 44 with the first vertical portion 60 of the cam surface 46 determines the amount of rotation of the beam 36. Likewise, the pivotal connection 40 has again rotated relative to the pivotal connection 38, and specifically the connection point 40 continues to move upwardly or vertically relative to the pivotal connection 38 and closer to pivotal connection 28 (distance denoted by $B_3$). Thus a greater force ratio $A/B_3$ is generated.

Figure 10:
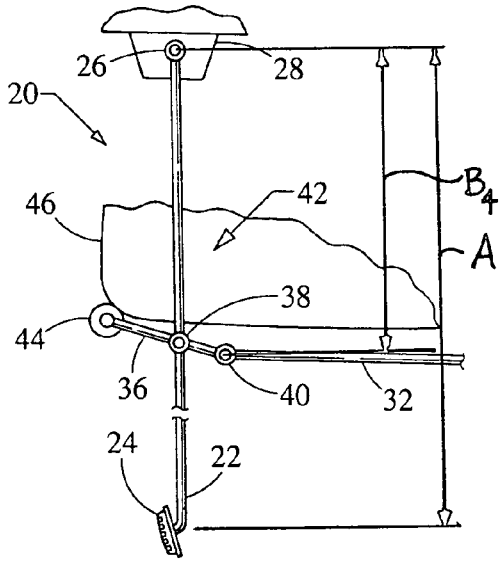

In FIG. 10, the pedal arm 22 and input rod 32 continue to move to the right through the pedal travel, while the beam 36 continues to rotate as dictated by the cam surface 46. Here, the roller 44 has reached the curved surface 64 of the cam while the pivot point 40 continues to move vertically relative to the pivot point 38 as the beam 36 rotates counterclockwise. The distance $B_4$ is likewise shorter, giving a greater force ration of $A/B_4$. Finally, in FIG. 11, the brake pedal 24 and pedal arm 22 have reached an extended position where the roller 44 has reached the substantially horizontal surface 62 of the cam profile 46, resulting in the beam 36 being fully rotated and substantially parallel to and aligned with the input rod 32. It will also be recognized that the pivot point 40 has been rotated to a position substantially vertically equal to the pivot point 38, resulting in the highest force ratio for the brake mechanism 20. That is, the distance $B_5$ is at its shortest, and remains relatively unchanged with further pedal travel to give a force ratio $A/B_5$ at its greatest value.

Figure 11:
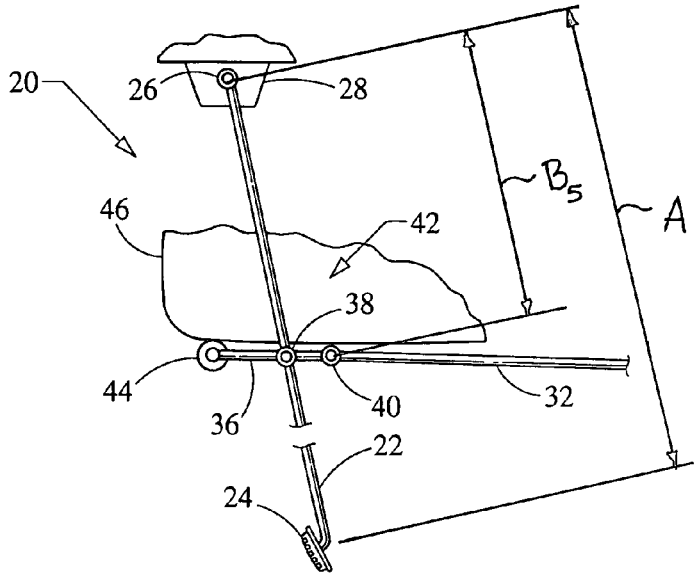
Figure 12:
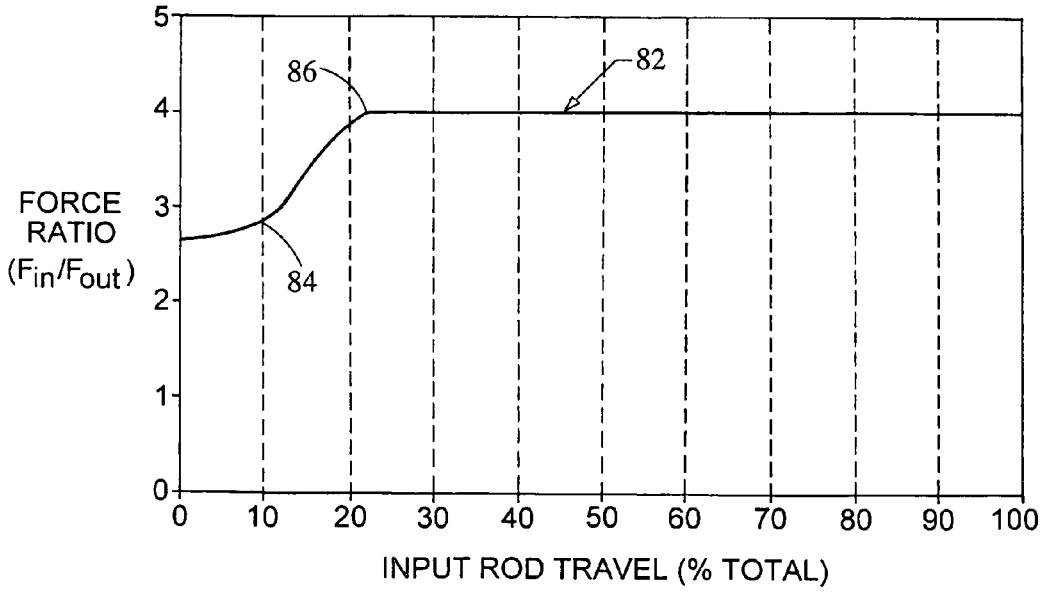
FIG. 12 is a graph showing the force ratio in relation to travel of the input rod for the brake mechanism depicted in FIGS. 1 and 2.

The effect of the idler beam 36 and the shape of the cam 42 on the force ratio of brake mechanism 20 has been depicted in the graph of FIG. 12. The input rod travel 32 is depicted on the X-axis as a percentage of total travel. The force ratio (force out divided by force in) is shown in the Y-axis, and the line 82 represents the force ratio throughout the input rod travel. As the input rod 32 travels from 0 to 10%, it can be seen that the force ratio only slightly increases. At a first transition point 84, the force ratio begins to quickly increase during the input rod travel of about 10% to about 22%. At the second transition point 86, the beam 36 has fully rotated (as shown in FIG. 11), and the force ratio is set at its highest value of about 4. The extended horizontal surface 62 of the cam profile 46 maintains this force ratio throughout the remainder of the input rod travel.

Based on the foregoing, it will be recognized by those skilled in the art that by interposing an idler beam 36 between the pedal arm 22 and input rod 32, the force ratio of the brake mechanism 20 may be adjusted based on the relative rotational position of the beam 36. The rotation of the beam 36 through the pedal travel or input rod travel is determined by the cam 42 and its cam profile 46. Accordingly, the cam profile 46 may be designed and selected to achieve any desired characteristics of the brake mechanism 20, but the preferred embodiment has been selected to provide a rapid increase in force ratio until a certain point in pedal travel wherein the force ratio is maintained at a constant value that meets failed power requirements. Further, this decreases the initial pedal travel providing increased pedal feel to the vehicle operator. It will also be recognized that the particular point along the idler beam 36 at which the pedal arm 22 and input rod 32 are connected may be adjusted to achieve certain results or certain curvatures in the force ratio graph.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A brake mechanism for a braking system in a motor vehicle, the braking system including an input rod for effecting actuation of vehicle brakes, the brake mechanism comprising:

a pedal arm pivotally connected to the vehicle, a free end of the pedal arm having a brake pedal receiving an input force;

a beam interposed between the pedal arm and the input rod for transmitting an output force from the pedal arm to the input rod, the beam pivotally connected to the pedal arm and rotatable relative thereto;

a cam defining a cam profile, the beam contacting the cam and following the cam profile as the pedal arm swings relative to the vehicle, the cam profile shaped to adjust the position of the beam to modify the ratio of the output force to the input force of the brake mechanism.

2. The brake mechanism of claim 1, wherein the position of the beam relative to the pedal arm determines the force ratio of the brake mechanism.

3. The brake mechanism of claim 1, wherein the pedal arm travels between at least a neutral position and an extended position.

4. The brake mechanism of claim 3, wherein the force ratio quickly increases as the pedal arm travels beyond a predetermined point past the neutral position to the extended position.

5. The brake mechanism of claim 3, wherein the force ratio at the extended position is sufficient for vehicle braking in a failed power situation.

6. The brake mechanism of claim 3, wherein the beam is pivotally connected to the input rod, and wherein the beam rotates relative to the input rod as the pedal arm swings relative to the vehicle.

7. The brake mechanism of claim 6, wherein the beam is generally perpendicular to the input rod when the pedal arm is in the neutral position.

8. The brake mechanism of claim 6, wherein the beam is aligned with the input rod when the pedal arm is in the extended position.

9. The brake mechanism of claim 1, wherein the cam profile includes a first portion generally perpendicular to the input rod and a second portion generally parallel to the input rod.

10. The brake mechanism of claim 9, wherein the cam profile includes a third portion connecting the first and second portions, the third portion being curved in shape.

11. A brake mechanism for a braking system in a motor vehicle, the braking system including an input rod for transmitting force to a master cylinder for pressurizing braking fluid in brake lines leading to wheel brakes, the brake mechanism comprising:

a pedal arm pivotally connected to the vehicle, the pedal arm receiving an input force from an operator of the vehicle that is transmitted to the input rod as an output force for braking the motor vehicle;

a beam pivotally connected to the pedal arm at a first point along the beam, the beam connected to the input rod at a second point along the beam, the beam transmitting the output force from the pedal arm to the input rod;

a cam having a surface defining a cam profile;

the beam contacting the cam at a third point along the beam and following the cam profile, the beam pivoting relative to the pedal arm as the beam follows the cam profile to adjust the ratio of the output force to the input force of the brake mechanism.

12. The brake mechanism of claim 11, wherein the position of the beam relative to the pedal arm is determined by the shape of the cam profile.

13. The brake mechanism of claim 11, wherein the position of the second point relative to the first point is determined by the shape of the cam profile.

14. The brake mechanism of claim 11, wherein the position of the second point relative to the first point determines the force ratio of the braking mechanism.

15. The brake mechanism of claim 11, wherein the second point moves from a position vertically below the first point to a position substantially horizontally aligned with the first point.

16. The brake mechanism of claim 11, wherein the pedal arm travels between a non-braked position and a braked position, and wherein the second point moves vertically upward as the pedal arm travels from the non-braked position to the braked position.

17. The brake mechanism of claim 11, wherein the first point separates the second and third points.

18. The brake mechanism of claim 11, wherein the beam includes a roller at the third point, the roller contacting the cam and following the cam profile.

19. The brake mechanism of claim 11, wherein the surface of the cam defines a track defining the cam profile, the beam engaging the track.

20. The brake mechanism of claim 11, wherein the cam profile includes a substantially vertical surface transitioning into a substantially horizontal surface.

* * * * *